United States Patent [19]

Wilkening

[11] Patent Number: 4,515,146

[45] Date of Patent: May 7, 1985

[54] FIREPLACE DOOR

[76] Inventor: Donald W. Wilkening, Akeley, Minn. 56433

[21] Appl. No.: 543,626

[22] Filed: Oct. 20, 1983

[51] Int. Cl.[3] ..... F24C 15/10

[52] U.S. Cl. ..... 126/140; 126/194; 160/DIG. 9; 16/DIG. 11; 49/482

[58] Field of Search ..... 126/138, 139, 140, 141, 126/190, 194, 200, 202; 160/DIG. 9; 16/DIG. 11; 49/388, 482, 488, 489, 501

[56] References Cited

U.S. PATENT DOCUMENTS

| | | | |
|---|---|---|---|
| 2,156,799 | 5/1939 | Benedict | 160/DIG. 9 X |
| 2,707,946 | 5/1955 | Merryweather et al. | 126/202 X |
| 3,132,640 | 5/1964 | Chisholm et al. | 126/194 |
| 3,459,173 | 8/1969 | Lydle | 126/138 X |
| 3,913,558 | 10/1975 | Caldwell | 126/139 |
| 3,995,612 | 12/1976 | Dew | 126/139 |
| 4,027,650 | 6/1977 | Edwards | 126/140 |
| 4,300,528 | 11/1981 | Slemmons | 126/140 |
| 4,351,317 | 9/1982 | Matthews | 126/139 |
| 4,436,080 | 3/1984 | Evans | 126/139 |

FOREIGN PATENT DOCUMENTS

| | | | |
|---|---|---|---|
| 225688 | 12/1959 | Australia | 126/138 |

*Primary Examiner*—Margaret A. Focarino

*Attorney, Agent, or Firm*—Palmatier, Sturm, Sjoquist & Baker, Ltd.

[57] ABSTRACT

A fireplace door assembly having doors pivotally mounted on a frame to be mounted on the opening of a fireplace. The doors are mounted on hinges that provide adjustment along a vertical axis of rotation and the front of the frame. An adjustable fire resistant gasket is used for an air seal. A gravity operated latch is provided to maintain the door in a closed position.

7 Claims, 11 Drawing Figures

FIREPLACE DOOR

BACKGROUND OF THE INVENTION

1. This invention relates generally to fireplace doors and is more particularly directed to a fireplace door intended to be mounted on the front surface of a fireplace opening and provides adjustability of the door with respect to its orientation in a vertical sense and in a horizontal sense with respect to the sealing of a gasket.

2. Prior Art.

U.S. Pat. No. 3,459,173, issued Aug. 5, 1969, in the name of J. E. Lydle, for FIREPLACE FRONT OR SCREEN is representative of the general form of apparatus with which my apparatus is concerned. U.S. Pat. No. 4,230,091, issued Oct. 28, 1980, in the name of Kenneth E. Judge, et al, for STOVE is further representative of a structure having doors mounted on a front surface for access to the interior. It, too, is noted only for its general relationship to the field of invention of the subject matter of this application.

My invention addresses at least two of the deficiencies perceived in the prior art directed to fireplace doors. These are a lack of adjustability of the doors with respect to the frame in a simple facile manner so as to allow for adjustment of the doors relative to the frame when the frame becomes distorted either through mounting on an irregular out of line surface or through the heat encountered in the environment of a fireplace opening. A second deficiency of the prior art is establishing and maintaining a suitable seal around the edges of the doors and with respect to the opening in the frame mounted on the fireplace.

SUMMARY OF THE INVENTION

The fireplace door embodying the teaching and concepts of my invention is easily fabricated and adaptable to sundry and diverse environmental and structural differences encountered in installation and use.

The fireplace door incorporating my invention provides vertical and lateral adjustment of the doors with respect to the frame; lateral adjustment of the position and resilience of a door seal provided to engage the front of the frame when the door is in a closed position; and adjustable gravity operated latching apparatus for operating and maintaining the doors in a closed position.

The adjustable, pivotable disposition of the door on the front of the frame is provided by the use of angled hinge pins that are threaded into the top and bottom of the sides of a door and operable to be movably disposed in apertures provided in forwardly extending pivots mounted on the front of the frame. The hinge pin are individually adjustable laterally with respect to the side of a door so as to allow for adjustment with respect to the axis of rotation of the door and may be angularly disposed with respect to the axis of the apertures in the pivots into which the hinge pins extend, so as to allow for adjustment of the rear of the door with respect to the front of the frame.

A typical door includes a transparent panel that is mounted against a woven or knit fiberglass material which is folded over to present a continuous seal at the rear of the door for resilient sealing engagement with the front of the frame. The gasket material is disposed underneath a right angled inner frame, one leg of which is disposed against the inside of the transparent panel and the other disposed around the inside periphery of the door and is held in place by a plurality of screw threaded fasteners that allow for adjustable positioning of the other leg on top of the folded over gasketing material so as to control the size and shape of the rounded doubled portion at the rear of the door so as to compensate for variations in spacing as may occur and/or to increase or decrease the resiliency of the sealing portion as it effects the seal against the front of the frame.

The latch for the door is disposed at the top and includes a latch pin that extends through a tube attached to the top of the door and is provided with an elongated handle and operator at its forward end and with a latching portion at its rear end that is disposed at an angle from the central body of the latch pin for rotation adjacent to and in the plane of the front top side of the frame. A catch, including a latch pin receiving notch, adjacent the front top side of the frame is mounted to extend forwardly of the top front of the frame so that the notch may be engaged with the latch pin in a locked position as the latch pin is rotated by the gravity forces exerted upon the handle and operator.

DESCRIPTION OF THE INVENTION

Figure 1:
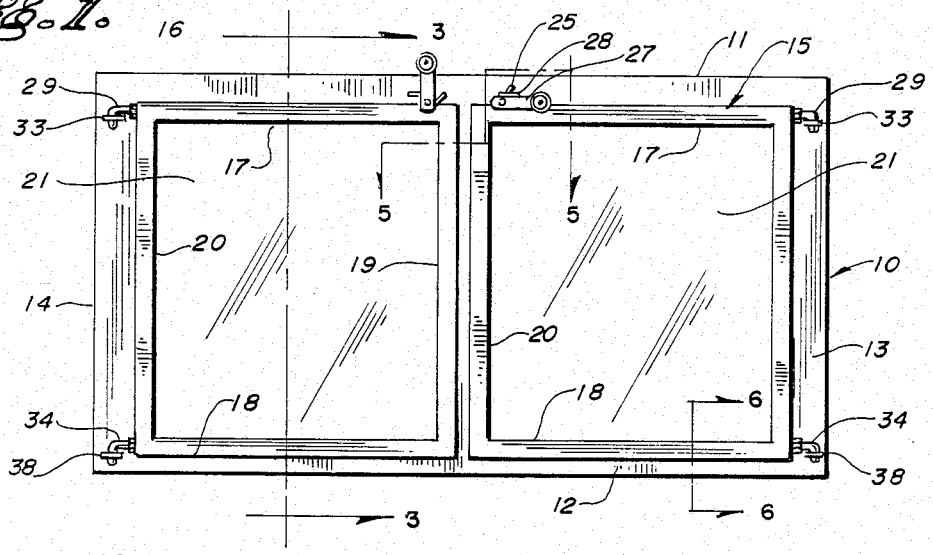
FIG. 1 is a front elevational view of a fireplace door embodying the principles of my invention.
Figure 2:
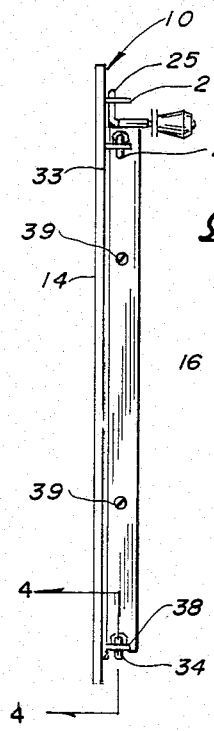
FIG. 2 is a side elevational view of the left side of FIG. 1.
Figure 3:
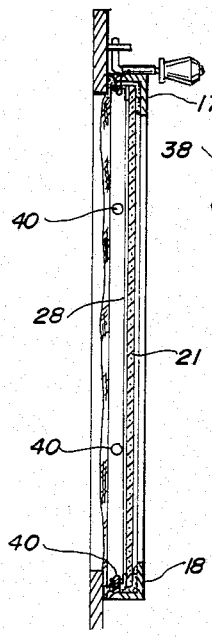
FIG. 3 is a sectional view taken along section line 3—3 on FIG. 1.
Figure 4:
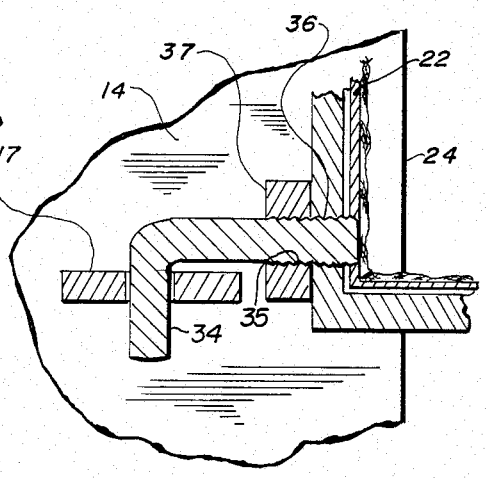
FIG. 4 is an enlarged fragmentary sectional view taken along section line 4—4 on FIG. 2.

Referring to the drawings in which like elements have been referred to by like reference characters, FIG. 1 of the drawings shows a frame 10 upon which right and left doors 15 and 16 are pivotally and latchably disposed. Frame 10 is adapted through means (not shown) to be disposed over the front of a fireplace opening.

Frame 10 is generally flat and includes top and bottom portions 11 and 12 and right and left side portions 13 and 14.

Right and left doors 15 and 16 include right angle shaped top and bottom portions 17 and 18 and right and left side portions 19 and 20 disposed and positioned to form a generally rectangularly shaped frame with the top, bottom and side portions joined together, as by welding, at the intersecting corners. A flat rectangular panel 21 comprised of heat resistant material such as tempered glass is mounted on the inside of doors 15 and 16. The inside periphery of doors 15 and 16 contains a plurality of retainer clamps 22, having a right angle cross section and having one leg disposed toward the inside front of doors 15 and 16 and the other leg parallel to and disposed on the rearwardly extending portions of the doors. Retainer clamps 22 are mounted on bolts 39 and are adjustable with respect to the sides of doors 15 and 16 through suitable positioning of nuts 40. A more or less continuous gasket 23 comprising material formed of knit or woven fiberglass material, for example, has a single layer disposed in front of transparent panel 21 and extends rearwardly underneath retainer clamps 22 to the rear of doors 15 and 16 and is doubled over to form a loop 24 at its inner edge and extends forwardly underneath retainer clamps 22.

Latch pin 25 is shown rotatably disposed in tube 26 mounted, as by welding, on the top of doors 15 and 16. Latch pin 25 is provided with a handle 27 at its forward end adjacent tube 26 and is bent at its rear end at a right angle to provide for engagement with the notch formed by catch 28 adjacent the front face of top 11 on frame 10.

The right and left sides 19 and 20 of doors 15 and 16 are provided with threaded apertures 31 and 36 to receive upper and lower hinge pins 29 and 34, respectively. The hinge pins are formed in the shape of an L and are threaded at one end for insertion into threaded apertures 31 and 36 and are held in place through the use of jam nuts 32 and 37, respectively. Upper and lower hinge pins 29 and 34 are oriented and disposed to be removably inserted into upper and lower pivots 33 and 38 mounted upon, as by welding, and extending forwardly of right and left sides 13 and 14 on frame 10.

Frame 10, doors 15 and 16, retainer clamp 22, latch 25 and hinge pins 29 and 34 may be fabricated of suitable material, such as steel. Panel 21 may be fabricated of suitable fire resistant glass or the like. Gasket 23 may be fabricated of suitable woven fire resistant material, such as fiberglass or the like.

Figure 8:
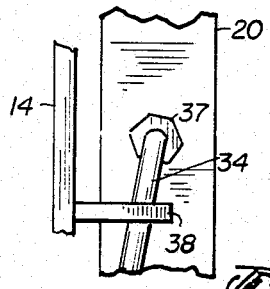
FIGS. 8, 9 and 10 are enlarged fragmentary side elevation views of the adjustable hinge of my invention showing the elements in differing states of adjustment.
Figure 9:
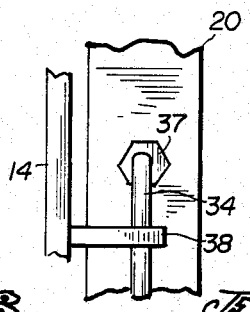
Figure 10:
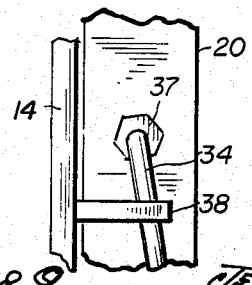
Figure 6:
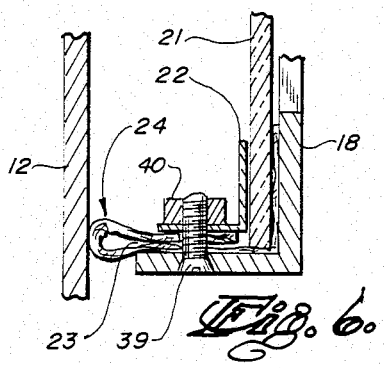
FIGS. 6 and 7 are enlarged fragmentary views taken along section line 6—6 on FIG. 1 and showing the elements in two states of adjustment.
Figure 7:
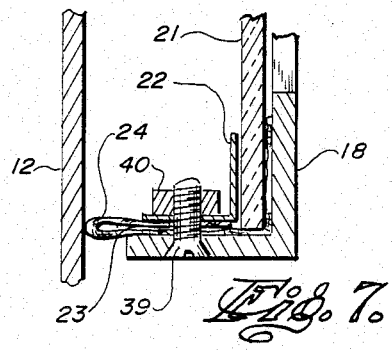
Figure 5:
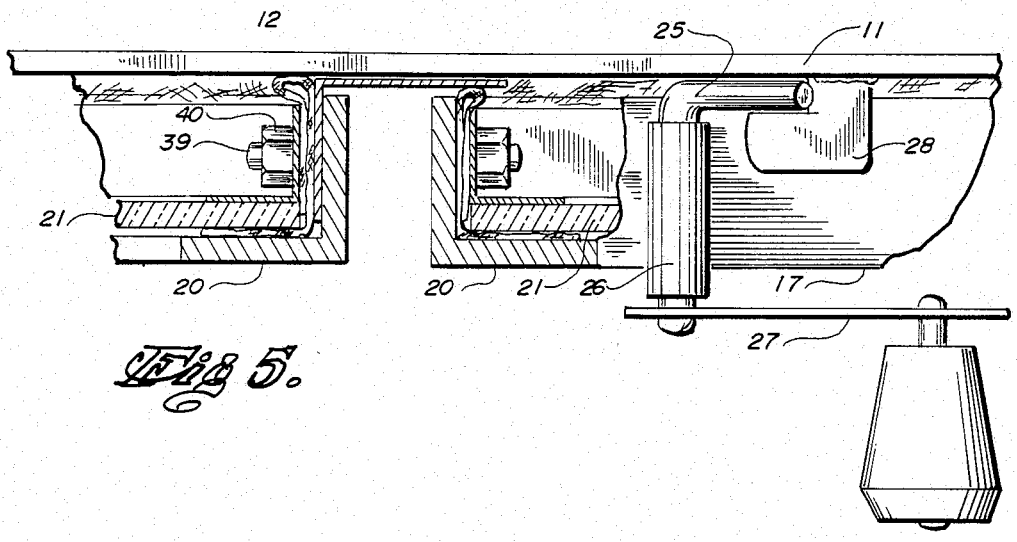
FIG. 5 is an enlarged fragmentary sectional view taken along section line 5—5 on FIG. 1.
Figure 11:
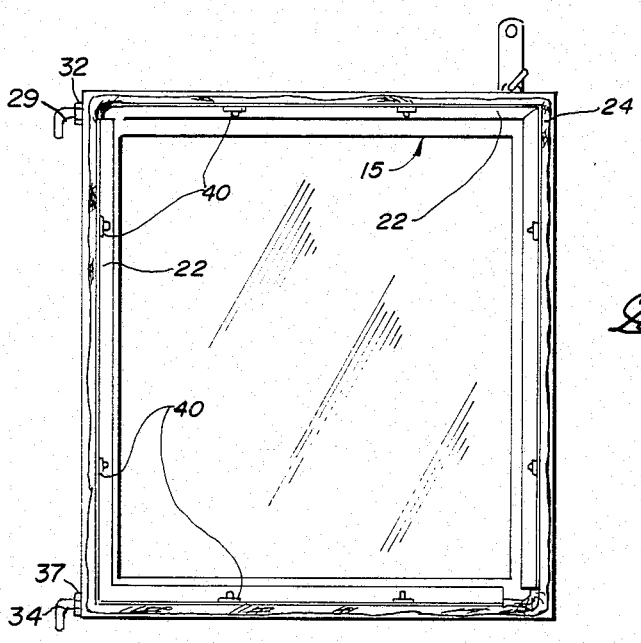
FIG. 11 is a rear elevational view of a fireplace door.

Referring to FIGS. 4, 6, 7, 8, 9 and 10, it may be seen that the conjoint adjustment of hinge pins 29 and 34 and retainer clamps 22 will result in proper physical alignment of doors 15 and 16 with respect to frame 10 and to a vertical axis, as well as to provide an effective air seal through engagement of the looped inner portion 24 of gasket 23 with the front of frame 10. This is accomplished by adjustment of hinge pins 29 and 34 as illustrated in FIGS. 8, 9 and 10 to vary the spacing between the rear portion of doors 15 and 16 with respect to the front of frame 10 and by tightening or loosening bolts and nuts 39 and 40 to vary the extension of the looped inner portion 24 of gasket 23.

INSTALLATION AND OPERATION

Gasket 23 may, if desired, be comprised of a first, separate, vertically disposed portion that is positioned between panel 21 and the rear of the front portions of the sides of doors 15 and 16; and a second doubled over portion, including loop 24, disposed intermediate clamps 22 and the inside facing portions of the sides of doors 15 and 16.

In a typical installation, doors 15 and 16 are removed and frame 10 is fastened to or within the opening of a fireplace by suitable mounting means (not shown). Upper and lower hinge pins 29 and 34 on doors 15 and 16 are inserted into the holes provided in upper and lower pivots 33 and 38 extending forwardly of the side portions 13 and 14 on frame 10. Doors 15 and 16 are latched in the closed position through the operation of latch 25 and held in that position through the coaction between the inner end of latch 25 and the notch formed by catches 28 extending forwardly from top 11 on frame 10. The alignment of doors 15 and 16 is noted and any necessary adjustments are provided by either the threaded adjustments of portions 30 and 35 on upper and lower hinge pins 29 and 34 as illustrated in FIGS. 8, 9 and 10, and, following this, the disposition of the rounded inner portion 24 of gasket 23 is noted and adjustments to various portions of gasket 23 are effected by tightening or loosening bolts 39 to vary the position of retainer clamp 22 at the desired location.

I claim:

1. A fireplace door comprising, in combination;

a rectangular frame to be mounted on the front of a fireplace and having at least one rectangular opening;

a door dimensioned to overlie said frame over each opening in said frame;

laterally and angularly adjustable hinge means pivotally mounting the side of said door to one side of said frame, said hinge means disposed at the top and bottom side of said door and said frame;

adjustable mounting means on the inside periphery of said door;

a transparent panel disposed intermediate said mounting means and the inside of said door;

gasket means disposed intermediate said adjustable mounting means, said panel and said door, said gasket means including a looped portion extending toward said frame and being comprised of resilient, fire resistant material; and latch means rotatably disposed on top of each door, said latch means operable to engage a catch extending forwardly of the top of said frame and including an operating handle operable to bias said catch means into engagement with said catch.

2. A fireplace door comprising, in combination;

a rectangular frame to be mounted on the front of a fireplace and having at least one rectangular opening;

a door dimensioned to overlie said frame over each opening in said frame;

laterally and angularly adjustable hinge means pivotally mounting the side of said door to one side of said frame, said hinge means disposed at the top and bottom side of said door and said frame;

adjustable mounting means on the inside periphery of said door; and gasket means disposed intermediate said adjustable mounting means and said door, said gasket means including a looped portion extending toward said frame and being comprised of fire resistant, resilient material.

3. The apparatus of claim 2 in which the laterally and angularly adjustable hinge means are comprised of an L shaped hinge pin having a threaded leg disposed in a threaded aperture in the side of the door, jam nut means disposed on the threaded portion of said threaded leg and in engagement with the side of said door and an apertured pivot mounted on the front of the frame for slideably receiving the other leg of said hinge pin.

4. The apparatus of claim 2 in which the adjustable mounting means for the gasket is comprised of a laterally extendent member and a plurality of bolts extending through said member and the edge of the door and the gasket means is comprised of a folded resilient woven membrane disposed between said laterally extending member and the inner side of the edges of the door.

5. The apparatus of claim 3 in which the adjustable mounting means for the gasket is comprised of a laterally extendent member and a plurality of bolts extending through said member and the edge of the door and the gasket means is comprised of a folded resilient woven membrane disposed between said laterally extending member and the inner side of the edges of the door.

6. A fireplace door comprising, in combination;

a rectangular frame to be mounted on the front of a fireplace and having at least one rectangular opening;

a door dimensioned to overlie said frame over each opening in said frame; and laterally and angularly adjustable hinge means comprised of an L-shaped hinge pin having a threaded leg disposed in a threaded aperture in the side of the door, jam nut means disposed on the threaded portion of said threaded leg and in engagement with the side of said door and an apertured pivot mounted on the front of the frame for slidably receiving the other leg of said hinge pin, pivotally mounting the side of said door to one side of said frame, said hinge means disposed at the top and bottom side of said door and said frame.

7. A fireplace door comprising, in combination;

a rectangular frame to be mounted on the front of a fireplace and having at least one rectangular opening;

a door dimensioned to overlie said frame over each opening in said frame;

adjustable mounting means comprised of a laterally extendant member and plurality of bolts extending through said member and the edge of the door on the inside periphery of said door; and gasket means disposed intermediate adjustable mounting means and said door, said gasket means comprised of a folded resilient woven membrane disposed between said laterally extending member and the inner side of the edges of the door and including a looped portion extending toward said frame and being comprised of fire resistant, resilient material.

* * * * *